US007775755B2

(12) United States Patent
Bailly et al.

(10) Patent No.: US 7,775,755 B2
(45) Date of Patent: Aug. 17, 2010

(54) LIMIT STOP AND SUPPORT DEVICE FOR FITTING VARIABLE-WIDTH PLASTERBOARDS USING LIFTING AND HANDLING APPLIANCES FOR SAID BOARDS

(75) Inventors: Jean-Marc Bailly, Ambierle (FR); Denis Narelli, Saint Haon Le Chatel (FR); Christophe Valette, Saint Bonnet De Cray (FR)

(73) Assignee: Roger Mondelin SAS, Ambierle (FR)

( * ) Notice: Subject to any disclaimer, the term of this patent is extended or adjusted under 35 U.S.C. 154(b) by 348 days.

(21) Appl. No.: 11/867,778

(22) Filed: Oct. 5, 2007

(65) Prior Publication Data

US 2008/0253865 A1 Oct. 16, 2008

(30) Foreign Application Priority Data

Oct. 9, 2006 (FR) ..... 06 54149

(51) Int. Cl.
*E04G 21/14* (2006.01)

(52) U.S. Cl. ..... 414/11; 269/17; 269/152

(58) Field of Classification Search ..... 118/500; 211/7–8; 224/231, 924; 254/2 C, 4 C, 6 C; 269/17, 254 CS; 410/105, 130, 132, 133, 410/134, 138, 139, 141, 142, 145; 414/10, 414/11, 12; 248/227.4, 228.2, 228.3, 230.2, 248/231.31, 231.41

See application file for complete search history.

(56) References Cited

U.S. PATENT DOCUMENTS

| | | | | | |
|---|---|---|---|---|---|
| 1,633,810 | A | * | 6/1927 | Fellows | 101/383 |
| 1,849,673 | A | | 3/1932 | Johnston | |
| 2,316,971 | A | | 4/1943 | Overacker et al. | |
| 2,575,751 | A | * | 11/1951 | Donnelley | 410/149 |
| 2,627,821 | A | * | 2/1953 | Sjogren | 410/145 |
| 2,652,004 | A | * | 9/1953 | Stough | 410/145 |
| 4,650,392 | A | * | 3/1987 | Casteel | 414/680 |
| 4,772,000 | A | * | 9/1988 | Aubert | 269/137 |
| 4,867,362 | A | * | 9/1989 | Finnegan et al. | 224/319 |
| 4,995,538 | A | * | 2/1991 | Marengo | 224/329 |
| 5,271,701 | A | * | 12/1993 | Hopland | 414/139.7 |
| 2006/0065796 | A1 | | 3/2006 | Valette et al. | |

FOREIGN PATENT DOCUMENTS

| | | | |
|---|---|---|---|
| EP | 1640537 | A2 | 3/2006 |
| FR | 2758150 | A1 | 7/1998 |
| FR | 2780428 | A1 | 12/1999 |
| GB | 736120 | A | 8/1955 |

OTHER PUBLICATIONS

French search report for FR 0654149, dated May 11, 2007.

* cited by examiner

*Primary Examiner*—Gregory W Adams
(74) *Attorney, Agent, or Firm*—Heslin Rothenberg Farley & Mesiti P.C.

(57) ABSTRACT

A limit stop support device for fitting variable-width plasterboards upon appliances for lifting and handling such boards comprises a one-piece receiving support which fulfils various adjustable-position sliding functions along a holder arm of the board holder or panel holder. The support receives a board or panel limit stop which is retractable in opposition to elastic return element(s) located on the receiving support, and a unit which fulfills a dual function of locking the receiving support in position on the arm and limiting the travel of the limit stop in opposition to the elastic return element(s) in an operating phase in order to place boards and panels on a ceiling and/or wall.

11 Claims, 12 Drawing Sheets

LIMIT STOP AND SUPPORT DEVICE FOR FITTING VARIABLE-WIDTH PLASTERBOARDS USING LIFTING AND HANDLING APPLIANCES FOR SAID BOARDS

CROSS REFERENCE TO RELATED APPLICATIONS

This application claims priority from French patent application No. 0654149, filed on Oct. 9$^{th}$, 2006, the entire disclosure of which is incorporated herein by reference.

BACKGROUND ART

The invention relates to the technical field of lifting and handling appliances for plasterboards in order to place them on walls and ceilings.

For many years, the Applicant has developed appliances of this type which are marketed under the brand name LEVPANO and which are the subject of numerous patents (EP 1640531, FR 2758150, FR 2780428). The Applicant is therefore one of the leading European companies which manufacture and market such appliances. Currently commercially available plasterboards have a standard width of 1200 mm. Nevertheless, there are signs of changes because plasterboards are becoming increasingly thicker and, consequently, more and more heavy. Moreover, in an attempt to ensure ease of handling, plasterboard manufacturers have been led to reduce the width of boards to 900 mm in the case of certain models and 600 mm for others, especially the 13 mm thick plasterboards which are most commonly fitted. There are therefore plasterboards of different widths: 600, 900 and 1200 mm.

In order to be able to fit plasterboards having these various widths, the Applicant has been led to revise the design of the board support in order to adapt to this new market situation. Because there was previously only one single plasterboard width, board supports were designed with fixed limit stop means at the end of the arms of the board support. Various solutions have been envisaged for solving the problem of making the board support easily adaptable to the dimensions of the plasterboards.

Initial research was therefore carried out to adapt the dimensions of the board support to those of the actual boards in accordance with functional needs. In practice, implementing the board support with telescopic components proved difficult to achieve and was relatively impractical to manipulate.

Other research involved providing the possibility of moving and fixing the position of limit stop elements by a seating and gripping effect with the plasterboard in question resting on these limit stop elements. In practice, such an implementation also proved to be relatively impractical, involving random positional adjustments and variable pressure forces and fixing which caused deterioration of the actual board holder.

The Applicant's approach was therefore to take a different direction by trying to design a means of quickly positioning the board limit stops safely, taking into account the lifting forces and handling of heavy loads involved. The Applicant also considered other possible changes in the dimensions of plasterboards over time involving dimensions other than the three dimensions currently adopted as stated above.

Also, according to the prior art, the limit stops arranged on the board support arm were capable of retracting in order to enable the board to press against the ceiling during installation, but the realisation of this implementation remained very hit and miss. Tackling this situation was therefore another of the Applicant's objectives.

The solution devised by the Applicant achieves all these objectives by being simple and safe and allowing easy, quick adjustment of the position of the limit stops depending on the dimensional constraints of the plasterboards. The Applicant's solution therefore satisfactorily copes with the constraints and stresses that are inherent in operating lifting and handling appliances which require phases during which boards are slanted and swivelled so that they are horizontal or vertical.

BRIEF SUMMARY OF THE INVENTION

According to a first aspect of the invention, the limit stop support device for variable-width plasterboards using appliances for lifting and handling said boards is distinctive in that it comprises a one-piece receiving support which fulfils various positional adjustment sliding functions along the holder arm of the board holder or panel holder, for receiving a board or panel limit stop which is retractable in opposition to elastic means located in said receiving support and a unit which fulfils a dual function of locking the receiving support in position on the arm and limiting the travel of the limit stop in opposition to the elastic return means of the limit stop in the operating phase in order to place boards and panels on the ceiling and/or wall.

These aspects and others will become apparent from the following description.

BRIEF DESCRIPTION OF THE DRAWING FIGURES

The object of the present invention is described, merely by way of example, in the accompanying drawings in which.

DETAILED DESCRIPTION

Figure 1:
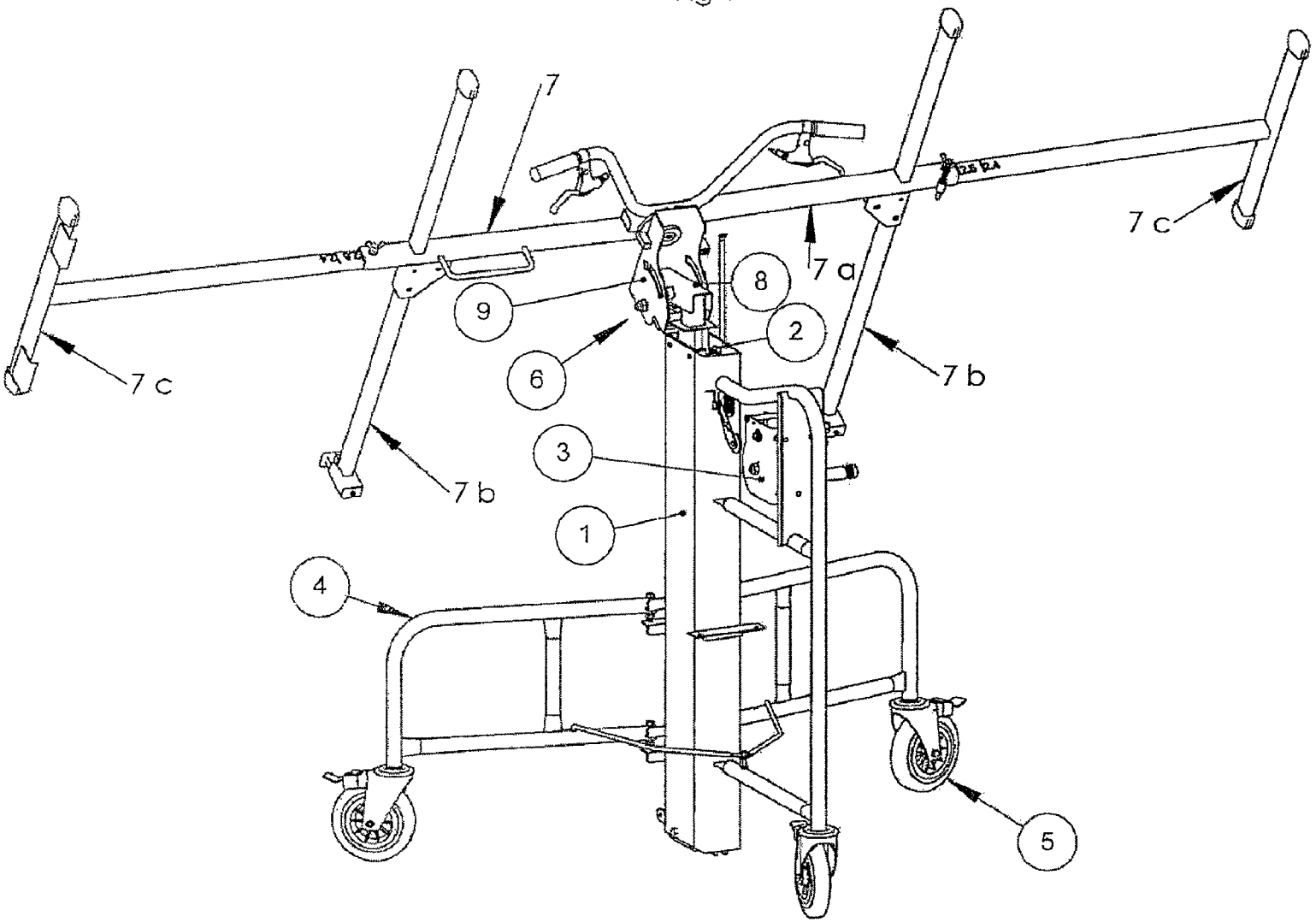
FIG. 1 is a schematic view showing an appliance for lifting and handling sheets of materials according to the prior art.

In order that the object of the invention may more readily be understood, the following description is given, merely by way of example, reference being made to the accompanying drawings.

First of all, the limit stop support device for fitting boards made of plaster and similar materials can be adapted and can be used to equip all types of lifting and handling appliances for fitting boards, especially the Applicant's appliances. Reference is made, merely by way of example, to a lifting and handling appliance developed by the Applicant merely to make the invention more readily understandable. In a known manner, the appliance comprises a mast (1) forming a vertical protective gear-case inside which there are telescopic elements (2) capable of being raised successively by winch control (3). Bases (4) with castors (5) make it possible to move the appliance and ensure it remains stable. The appliance comprises a device (6) for articulating plasterboard or panel support (7). Support (7) comprises holder arm (7*a*) which has, over its width, arms or cross pieces (7*b*) and at its ends T-shaped extensions (7*c*) which can slide and be adjusted depending on the length of the panels. According to the prior art, the limit stops are fixedly located on the cross piece and make it possible to support the boards or panels that are to be positioned.

Figure 2:
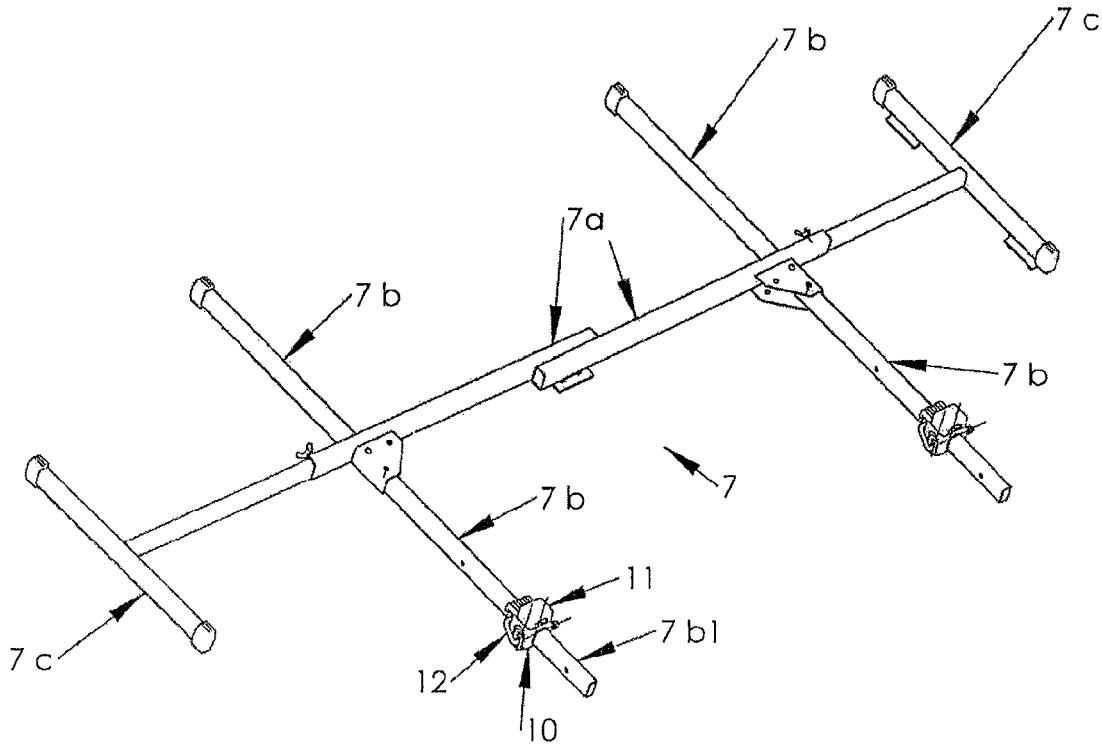
FIG. 2 is a perspective view showing the plasterboard support arm equipped with a limit stop support device according to the invention.

According to the invention and in order to solve the problems mentioned above, said arms are located on the side which receives the limit stops with a plurality of holes (7*b*1) and are located at specific locations matching the width of the boards or panels to be transported and fitted. Thus, FIG. 2 shows arms which have three holes to match the width of 600, 900 and 1200 mm panels.

The limit stop support device according to the invention is thus designed and arranged with a limited number of components allowing it to be positioned depending on the size of the boards or panels, allowing it to be locked in position, thus defining limited travel of the limit stop part during the operating phase when placing the board or panel against the receiving ceiling and/or wall.

To achieve this, the device comprises a first so-called receiving support component (10) which fulfils various sliding functions along arm (7*b*) of the board holder or panel holder and receiving the limit stop (11) of a unit (12) which has the dual function of locking in position and limiting the travel of the limit stop and also receiving elastic return means (13) of the limit stop in the operating phase.

Figure 10:
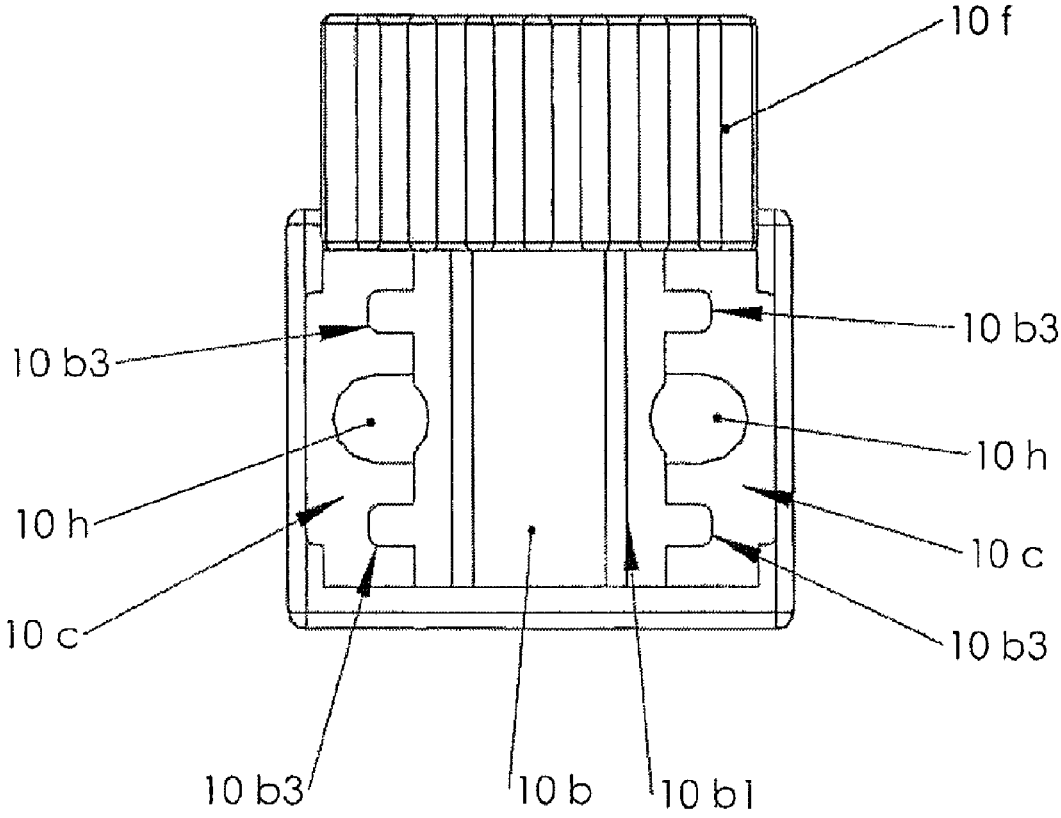
FIG. 10 is a top view of the limit stop support.

More especially, said receiving support (10) is of one-piece construction and made of any appropriate, relatively rigid material. This receiving support (10) with a parallelepiped configuration comprises a vertically and transversely open base (10*a*) to allow, respectively, accommodation and guidance of limit stop (11) and to allow it to pass through and slide around arm (7*b*) of the board holder or panel holder. More especially, in its central and transverse position, there is a cavity (10*b*) through which said arm (7*b*) passes and is guided with two inner walls (10*b*1-10*b*2) which act as an intermediate separator and delimit two chambers (10*c*) through which wings (11*a*) shaped like a fork joint of limit stop (11) pass and are guided. Two opposite lateral outer walls (10*d*) of the base part are open with a shaped cut-out (10*e*) which matches the protruding shapes (11*b*) on the wings of limit stop (11). As apparent in the drawings, the positioning plan of the limit stop, and hence of the wings, is parallel to the central guide path for receiving the arm of the board holder so that the device can slide. More especially, inner walls (10*b*1-10*b*2) are arranged on the receiving side of the limit stop with protruding shapes (10*b*3) forming a guide around which the matching shaped inner shapes (11*c*) of the wings of the limit stop move. Thus, as apparent in FIG. 10, the bottom of the receiving support is arranged with support parts (10*e*) for spring-type return means (13). The bottom of the receiving support is not solid over its entire surface area so as to allow passage and vertical displacement of the limit stop under certain conditions.

The receiving support also comprises on its upper plane a horizontal support plane (10*f*) against which the board or panel to be positioned will rest and be positioned. The inner walls located in the base part of the receiving support extend underneath above-mentioned support plane (10*f*) and are each arranged with a hole (10*g*) through which locking unit (12), described below, can pass.

Figure 11:
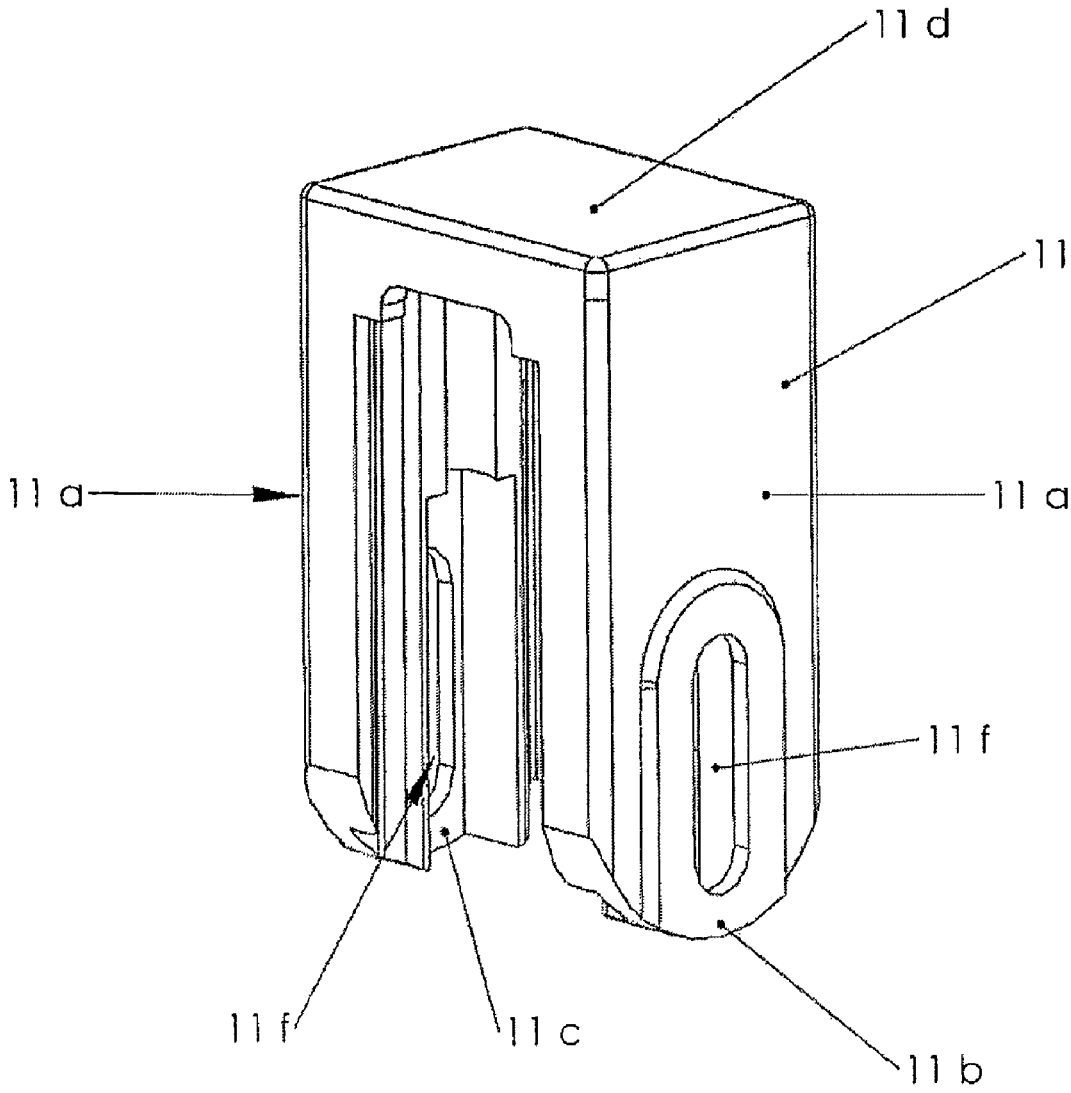
FIG. 11 is a perspective view of the actual limit stop.
Figure 12:
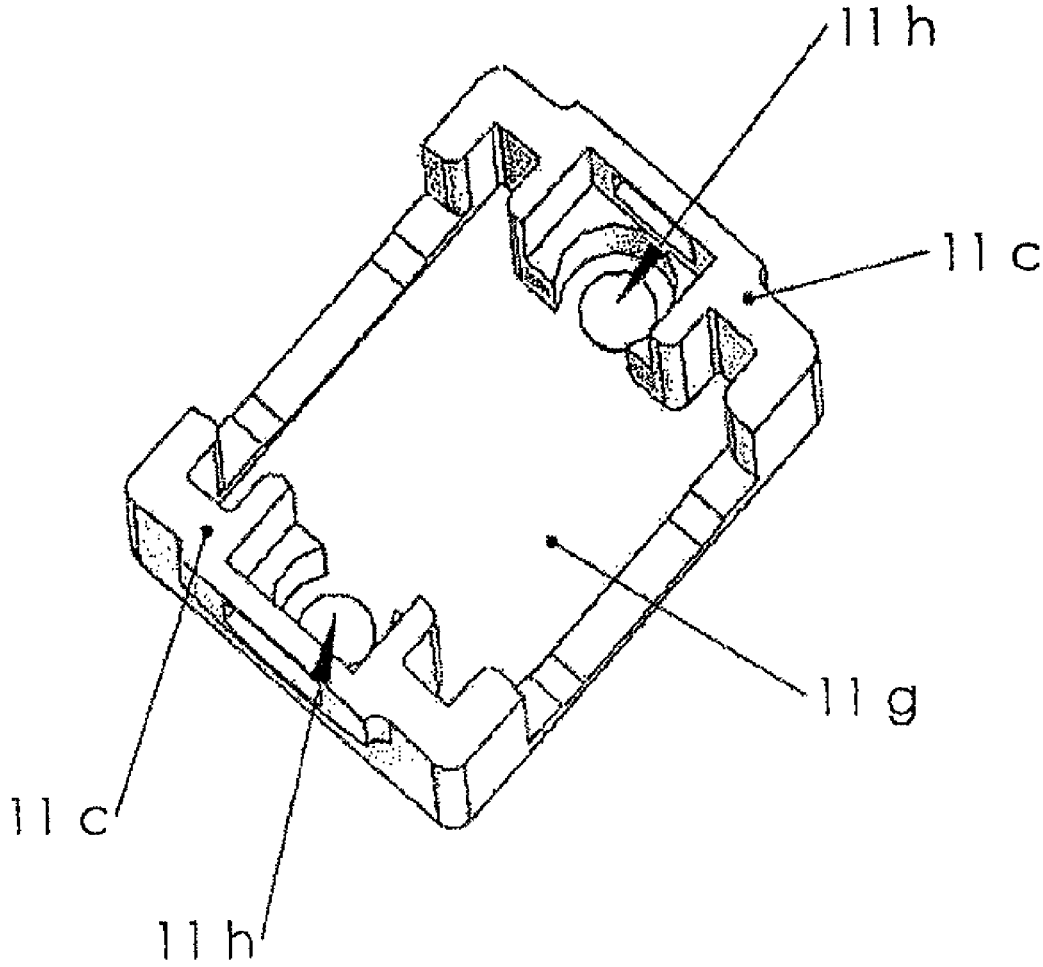
FIG. 12 is a perspective partial view showing the underside of the limit stop.

Limit stop (11) is retractable and capable of fitting and being centred in the receiving support having a U configuration with an upper base (11*d*) and two shaped wings (11*a*) which fit in the receiving chambers formed between inner walls (10*b*1-10*b*2) and opposite lateral walls (10*d*). Said wings are therefore internally and externally arranged to slide and be guided in limit-stop receiving support (10), thus receiving a means of limiting its travel. As stated above, internally the wings are arranged with a vertical groove (11*c*) to fit around said protrusions (10*b*3) which form a guide. Externally, each of the wings is arranged with an oblong vertical through-slot (11) in the thickness of said wings. These oblong slots are in the lower part of said wings. The retractable limit stop is shown in FIG. 11. In addition, the upper underside (11*g*) of the limit stop is arranged as shown in FIG. 12 with support studs (11*h*) for spring-type elastic return means (13). These means are thus centred between the receiving support and the limit stop beyond support planes (10*e*-11*h*).

The third component of the device according to the invention is unit (12) for locking the receiving support in position and limiting the travel of the limit stop. In practice, this unit is designed as a horizontally placed U-shaped pin. This pin comprises a bottom part (12*a*) located outside receiving support (10) and limit stop (11) with an upper leg (12*b*) capable of penetrating into holes (10*g*) in walls (10*b*1-10*b*2). When arm (7) accommodates the device according to the invention, leg (12*b*) passes through the latter and locks the device in position. The other long leg (12*c*) passes through the wings of the limit stop via the oblong slots provided for this purpose. This leg (12*c*) protrudes very substantially beyond the plane of the wing opposite to that into which the pin is inserted and accommodates elastic return means (14) with lock nut (15). Said return means (14) thus presses against the flank of the opposite-facing wing and underneath the head of the nut.

The operating principle of the device is explained below.

Figure 3:
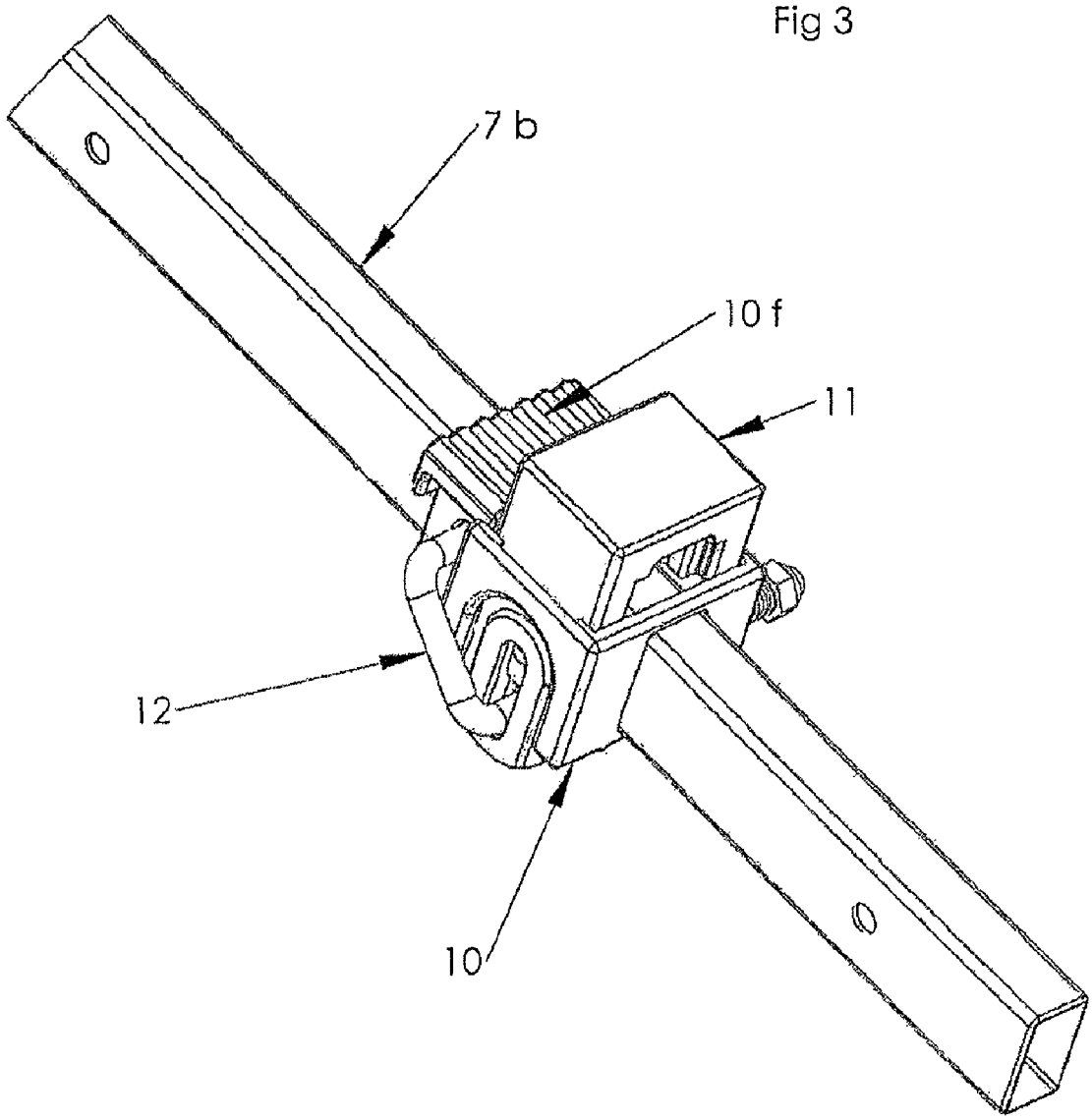
FIG. 3 is a partial view of a board support arm which receives the limit stop support device according to the invention.
Figure 4:
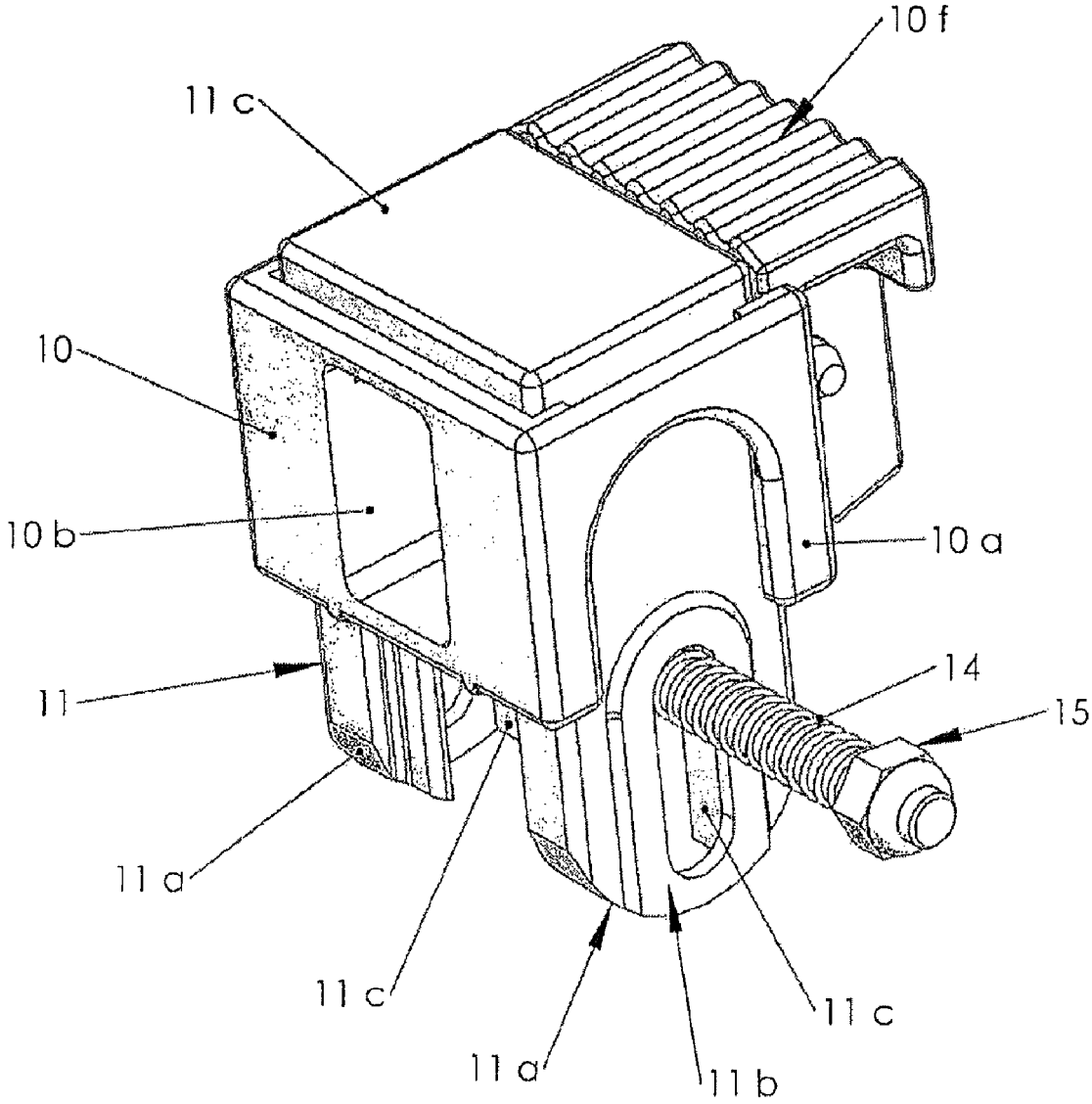
FIG. 4 is a three-quarter perspective view of the limit stop support device when the limit stop has slid to its lower limit if it presses against the ceiling and/or wall.
Figure 5:
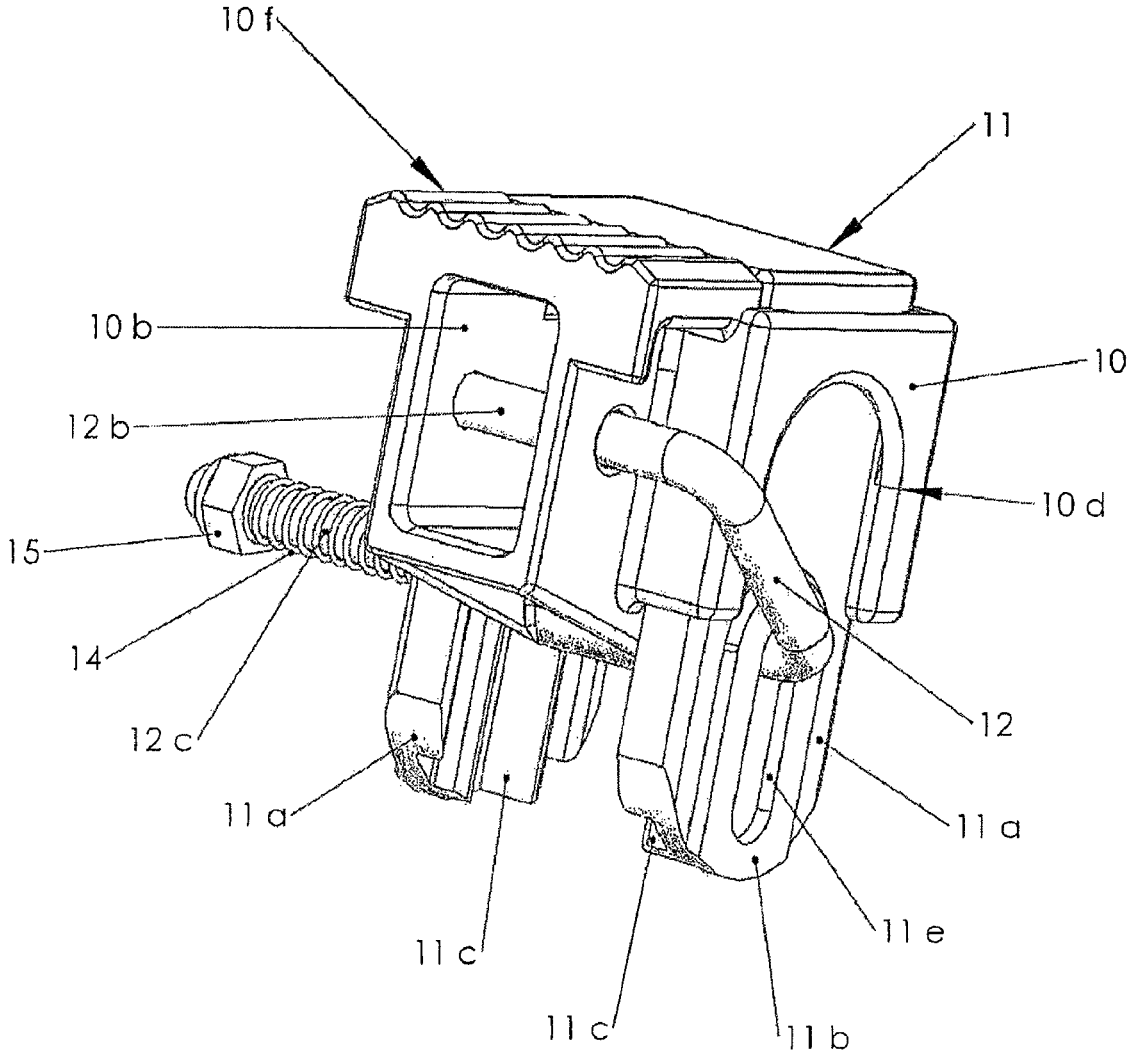
FIG. 5 is a perspective view of the device according to the invention oriented in a substantially different direction to that in FIG. 4 and showing, more especially, the configuration of the locking unit.
Figure 6:
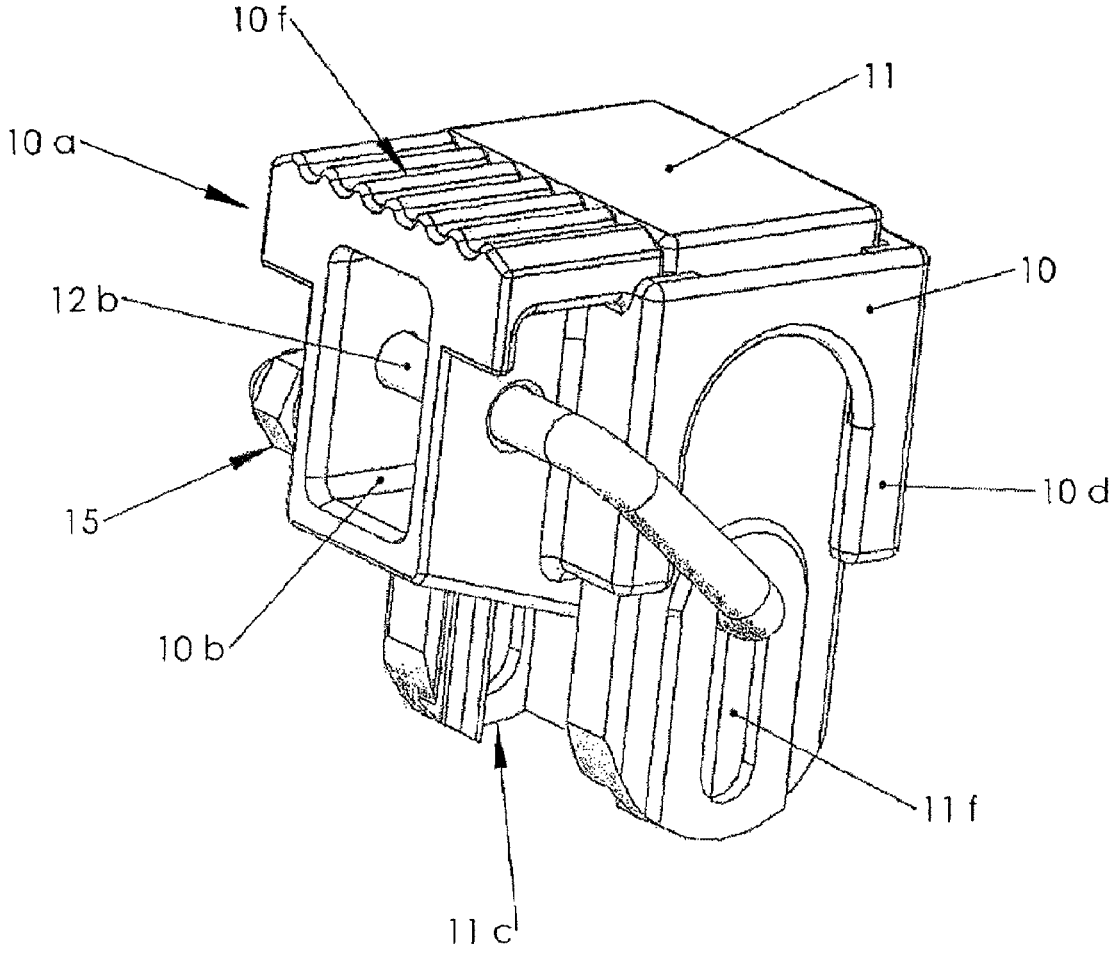
FIG. 6 is a perspective view of the device the opposite way round to FIG. 4.
Figure 7:
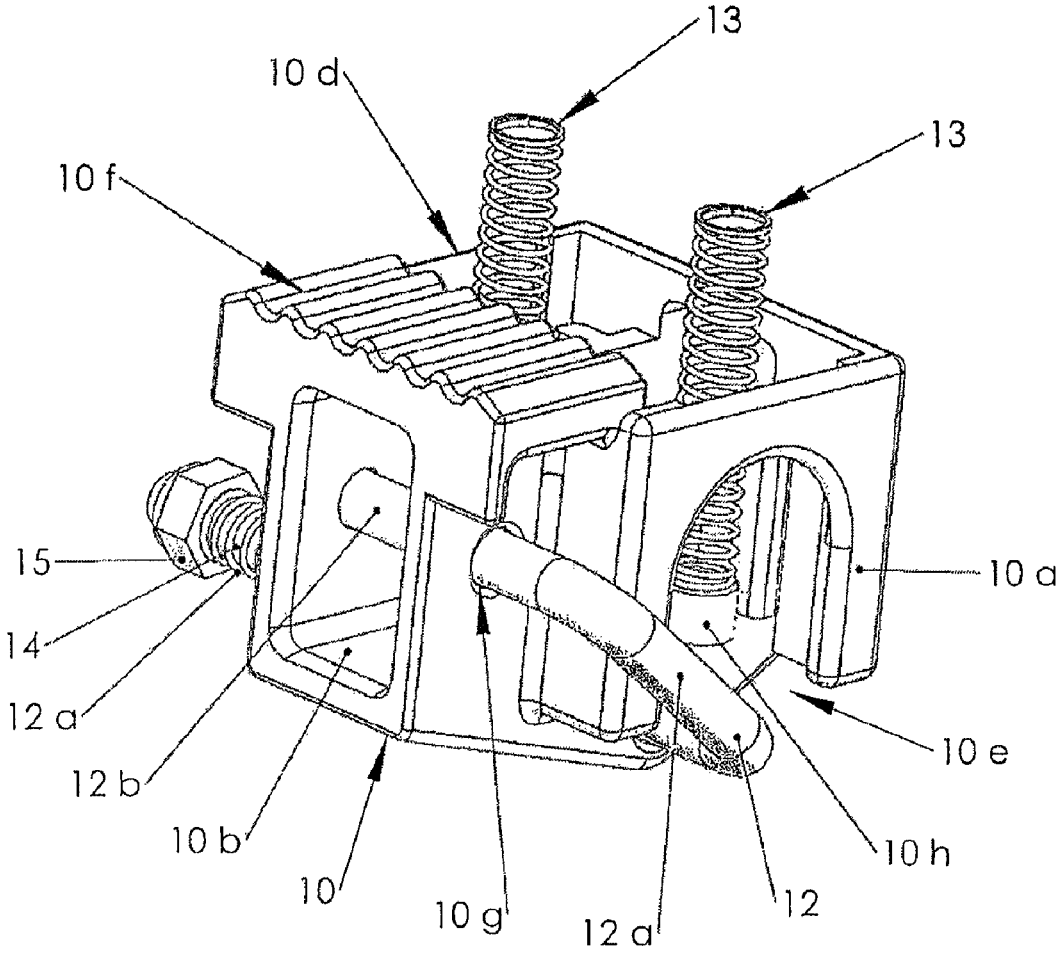
FIG. 7 is a perspective exploded view showing the limit stop support on its own with the locking unit and the elastic return means in the actual limit stop position.
Figure 8:
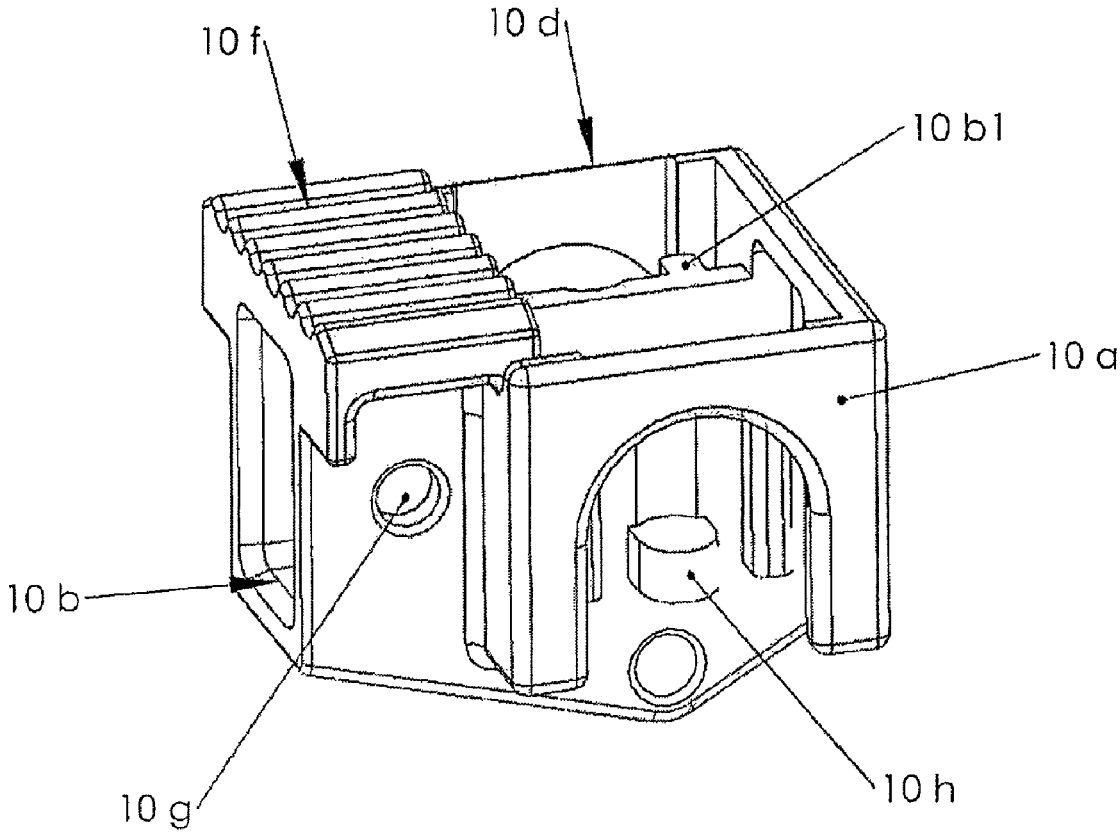
FIG. 8 is a perspective view of the limit stop on its own showing, in particular, the location where the elastic return means of the limit stop rests.
Figure 9:
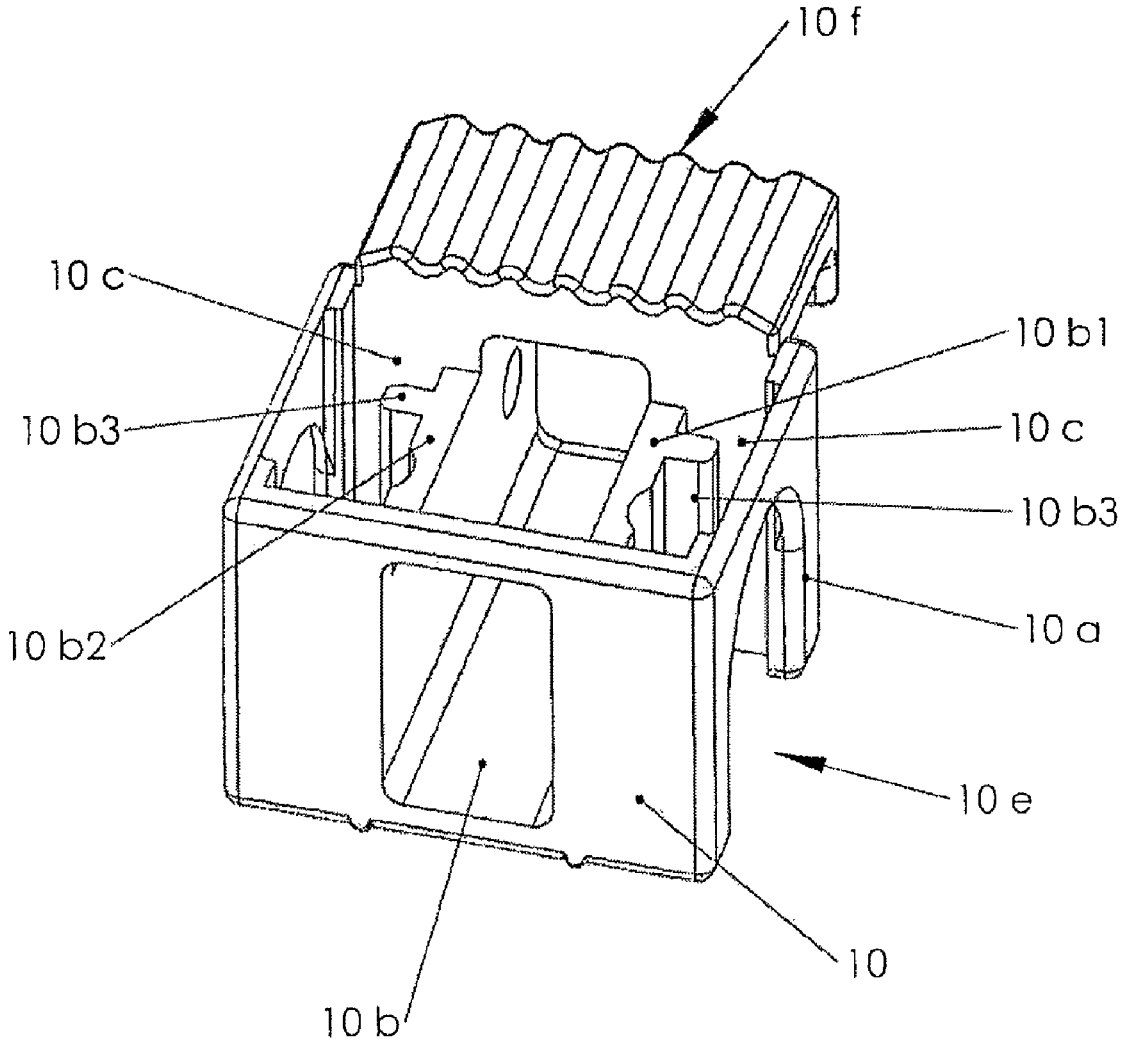
FIG. 9 is a perspective view of the limit stop support at a different angle showing the area where the board support arm is inserted.

Once the width of the plasterboard or sheet of material has been measured, the operator can place and position the device according to the invention on the holder arm in one of the openings in holder arm (7*b*). To do so, the operator merely has to actuate locking unit (12) by spreading the pin in opposition to the elastic return means associated with it (14) in order to allow the device to slide freely along the arm after releasing and freeing it. Having selected the right opening, repeating the above operation in reverse produces the locking configuration shown, for example, in FIG. 3. When the board holder or panel holder is close to and faces the wall or ceiling, limit stop (11) will retract in receiving support (10) in opposition to return means (13). The upper face of the limit stop will then face and be in the same plane as the upper part of said receiving support, making it possible to then place the board or panel.

The device according to the invention has a simple and inexpensive design and is extremely practical to handle. The dual function fulfilled by the device for positional adjustment on holder arm (7*b*) and limiting the travel of the limit stop is an important feature of the invention.

The invention claimed is:

1. A limit stop support device for fitting variable-width plasterboards upon an appliance for lifting and handling said boards, comprising a one-piece receiving support which fulfills various adjustable-position sliding functions along an arm of a board holder or panel holder of the appliance, the support receiving a board or panel limit stop which is retractable in opposition to elastic return means located in said receiving support and a locking unit which fulfills a dual function of locking the receiving support in position on the arm and limiting travel of the limit stop in opposition to the elastic return means in an operating phase in order to place boards and panels on a ceiling or wall, wherein the receiving support has a parallelepiped configuration and comprises a vertically and transversely open base part to allow, respectively, accommodation and guidance of the limit stop and to allow the limit stop to pass through and slide around the arm of the board holder or panel holder, the base part comprises in a central and transverse position a cavity through which said arm passes and is guided and two inner walls which act as an intermediate separator and delimit two chambers through which wings, shaped like a fork joint, of the limit stop pass and are guided, the base part of the receiving support is arranged with two opposite lateral outer walls having a shaped cut-out which matches protruding shapes on the wings of the limit stop, and a positioning plane of the limit stop and of the wings is parallel to a central guide path for receiving the arm of the board holder or panel holder so that the device can slide, the retractable limit stop has a U-configuration with an upper base and two shaped wings which fit in the chambers formed between the inner walls and opposite lateral walls, the wings are internally and externally arranged to slide and be guided in the receiving support and receive means of limiting travel of the limit stop, and the unit for locking the receiving support in position and limiting the travel of the limit stop comprises a horizontally placed U-shaped pin.

2. A device as claimed in claim 1, wherein the inner walls are arranged on a receiving side of the limit stop with protruding shapes forming a guide around which matching shaped inner shapes of the wings of the limit stop move.

3. A device as claimed in claim 1, wherein a bottom of the receiving support is arranged with support parts for the elastic return means.

4. A device as claimed in claim 1, wherein a bottom of the receiving support is not solid over an entire surface area of the bottom so as to allow passage and vertical displacement of the limit stop under certain conditions.

5. A device as claimed in claim 1, wherein the receiving support comprises on an upper plane a horizontal support surface against which the board or panel to be positioned rests and is positioned.

6. A device as claimed in claim 5, wherein the inner walls located in the base part of the receiving support extend underneath said support surface and are each arranged with a hole through which the locking unit can pass.

7. A device as claimed in claim 1, wherein:

internally, the wings are arranged with a vertical groove to fit around said protruding shapes which form a guide, externally, each of the wings is arranged with an oblong vertical through-slot in a thickness of said wings and each oblong slot is in a lower part of said wings, and an upper underside of the limit stop is arranged with support studs for the elastic return means.

8. A device as claimed in claim 1, wherein said pin comprises a bottom part located outside of the receiving support and the limit stop with an upper leg for penetrating into holes in the inner walls and an other long leg passes through the wings of the limit stop via oblong slots and said other leg protrudes substantially beyond a plane of a first wing opposite to a second wing into which the pin is inserted and accommodates another elastic return means with a lock nut, and wherein the another elastic return means presses against a flank of the first wing and underneath a head of the nut.

9. A limit stop support device for fitting variable-width plasterboards upon an appliance for lifting and handling said boards, comprising a one-piece receiving support which fulfills various adjustable-position sliding functions along an arm of a board holder or panel holder of the appliance, the support receiving a board or panel limit stop which is retractable in opposition to elastic return means located in said receiving support and a locking unit which fulfills a dual function of locking the receiving support in position on the arm and limiting travel of the limit stop in opposition to the elastic return means in an operating phase in order to place boards and panels on a ceiling or wall, wherein:

the receiving support has a parallelepiped configuration and comprises a vertically and transversely open base part to allow, respectively, accommodation and guidance of the limit stop and to allow the limit stop to pass through and slide around the arm of the board holder or panel holder, the base part comprises in a central and transverse position a cavity through which said arm passes and is guided and two inner walls which act as an intermediate separator and delimit two chambers through which wings, shaped like a fork joint, of the limit stop pass and are guided, wherein the base part of the receiving support is arranged with two opposite lateral outer walls having a shaped cut-out which matches protruding shapes on the wings of the limit stop, and wherein a positioning plane of the limit stop and of the wings is parallel to a central guide path for receiving the arm of the board holder or panel holder so that the device can slide.

10. A limit stop support device for fitting variable-width plasterboards upon an appliance for lifting and handling said boards, comprising a one-piece receiving support which fulfills various adjustable-position sliding functions along an arm of a board holder or panel holder of the appliance, the support receiving a board or panel limit stop which is retractable in opposition to elastic return means located in said receiving support and a locking unit which fulfills a dual function of locking the receiving support in position on the arm and limiting travel of the limit stop in opposition to the elastic return means in an operating phase in order to place boards and panels on a ceiling or wall, wherein:

the receiving support has a parallelepiped configuration and comprises a vertically and transversely open base part to allow, respectively, accommodation and guidance of the limit stop and to allow the limit stop to pass through and slide around the arm of the board holder or panel holder, the base part comprises in a central and transverse position a cavity through which said arm passes and is guided and two inner walls which act as an intermediate separator and delimit two chambers through which wings, shaped like a fork joint, of the limit stop pass and are guided, the retractable limit stop has a U-configuration with an upper base and two shaped wings which fit in the chambers formed between the inner walls and opposite lateral walls, the wings are internally and externally arranged to slide and be guided in the receiving support and receive means of limiting travel of the limit stop, internally, the wings are arranged with a vertical groove to fit around said protruding shapes which form a guide, externally, each of the wings is arranged with an oblong vertical through-slot in a thickness of said wings and each oblong slot is in a lower part of said wings, and an upper underside of the limit stop is arranged with support studs for the elastic return means.

11. A limit stop support device for fitting variable-width plasterboards upon an appliance for lifting and handling said boards, comprising a one-piece receiving support which fulfills various adjustable-position sliding functions along an arm of a board holder or panel holder of the appliance, the support receiving a board or panel limit stop which is retractable in opposition to elastic return means located in said receiving support and a locking unit which fulfills a dual function of locking the receiving support in position on the arm and limiting travel of the limit stop in opposition to the elastic return means in an operating phase in order to place boards and panels on a ceiling or wall, wherein:

the receiving support has a parallelepiped configuration and comprises a vertically and transversely open base part to allow, respectively, accommodation and guidance of the limit stop and to allow the limit stop to pass through and slide around the arm of the board holder or panel holder, the base part comprises in a central and transverse position a cavity through which said arm passes and is guided and two inner walls which act as an intermediate separator and delimit two chambers through which wings, shaped like a fork joint, of the limit stop pass and are guided, the unit for locking the receiving support in position and limiting the travel of the limit stop comprises a horizontally placed U-shaped pin, and said pin comprises a bottom part located outside of the receiving support and the limit stop with an upper leg for penetrating into holes in the inner walls and an other long leg passes through the wings of the limit stop via oblong slots and said other leg protrudes substantially beyond a plane of a first wing opposite to a second wing into which the pin is inserted and accommodates another elastic return means with a lock nut, and the another elastic return means presses against a flank of the first wing and underneath a head of the nut.

* * * * *